US010411428B2

(12) United States Patent
Wang

(10) Patent No.: US 10,411,428 B2
(45) Date of Patent: Sep. 10, 2019

(54) ELECTRICAL CONNECTOR

(71) Applicant: EmCom Technology Inc., Taipei (TW)

(72) Inventor: Chu-Li Wang, Taipei (TW)

(73) Assignee: EMCOM TECHNOLOGY INC., Taipei (TW)

( * ) Notice: Subject to any disclaimer, the term of this patent is extended or adjusted under 35 U.S.C. 154(b) by 0 days.

(21) Appl. No.: 16/120,879

(22) Filed: Sep. 4, 2018

(65) Prior Publication Data

US 2019/0074651 A1 Mar. 7, 2019

(30) Foreign Application Priority Data

Sep. 1, 2017 (TW) ..... 106130040 A

(51) Int. Cl.

| | |
|---|---|
| ***H01R 29/00*** | (2006.01) |
| ***H01R 35/02*** | (2006.01) |
| ***H01R 13/502*** | (2006.01) |
| ***H01R 13/56*** | (2006.01) |
| *H01R 13/6463* | (2011.01) |

(52) U.S. Cl.

CPC ..... *H01R 35/02* (2013.01); *H01R 13/502* (2013.01); *H01R 13/562* (2013.01); *H01R 13/6463* (2013.01)

(58) Field of Classification Search

CPC ..... H01R 29/00; H01R 27/00; H01R 103/00; H01R 4/34; H01R 31/06

USPC ..... 439/170

See application file for complete search history.

(56) References Cited

U.S. PATENT DOCUMENTS

| | | | | |
|---|---|---|---|---|
| 6,554,484 | B2 * | 4/2003 | Lampert | G02B 6/3895 385/70 |
| 6,637,949 | B2 * | 10/2003 | Loch | G02B 6/4202 385/53 |
| 6,821,031 | B2 * | 11/2004 | Loch | G02B 6/4292 385/53 |
| 7,153,040 | B2 * | 12/2006 | Loch | G02B 6/4202 385/92 |
| 7,641,399 | B2 * | 1/2010 | Loch | G02B 6/4202 385/53 |
| 2001/0043775 | A1 * | 11/2001 | Shirakawa | G02B 6/3829 385/59 |

FOREIGN PATENT DOCUMENTS

CN 101821911 A 9/2010

* cited by examiner

*Primary Examiner* — Phuong Chi T Nguyen

(74) *Attorney, Agent, or Firm* — Muncy, Geissler, Olds & Lowe, P.C.

(57) ABSTRACT

An electrical connector is provided. The electrical connector includes a body, a positioning component, and a movable cover. The body has a first end and a second end facing away therefrom. The first end has a first socket where an electrical plug is connected. The second end has a second socket where a transmission line is connected. The transmission line is arranged extending in a first direction. The positioning component is disposed at the second end. The lateral sides of the positioning component each include a first rib and a second rib. The first ribs and the second ribs extend along a second direction perpendicular to the first direction. The movable cover is disposed on a side of the positioning component away from the body. The movable cover is rotatable relative to the positioning component.

6 Claims, 3 Drawing Sheets

ELECTRICAL CONNECTOR

FIELD OF THE INVENTION

The present invention relates to an electrical connector, and more particularly to an electrical connector which enables transmission lines to be inserted therein at different angles.

BACKGROUND OF THE INVENTION

Conventional electrical connectors, such as telecommunication connectors, receive transmission lines at a single certain angle. However, transmission lines under restricted installation environment need to be bent before they can be connected to the electrical connector.

According to theories of information communication, the rate at which a conductive object transmits electromagnetic waves will be affected if the radius of curvature of the conductive object decreases. Taking Ethernet cables for example, when an Ethernet cable, which is usually formed of four twisted pairs, is bent without forming a radius of curvature, each twisted pair cable will generates scattered electromagnetic waves, causing the eight twisted cables inside the Ethernet cable to interfere with each other and thus reduce signal transmission efficiency.

SUMMARY OF THE INVENTION

Accordingly, the present invention provides an electrical connector including a body, a positioning component and a movable cover. The body has a first end and a second end facing away from the first end. The first end has a first socket to which an electrical plug is connected, and the second end has a second socket to which a transmission line is electrically connected along a first direction. The positioning component is disposed at the second end and has a first rib and a second rib on each of the lateral sides thereof. The first rids and the second ribs protrude from the lateral sides in a second direction perpendicular to the first direction. The movable cover is disposed on a side of the positioning component away from the body, in which the movable cover is rotatable relative to the positioning component.

Compared to electrical connectors in the prior art, the electrical connector of the present invention with the structure of the movable cover and that of the positioning component enables the adaption of the angle at which the transmission line enters the electrical connector, preventing the transmission line from being overly bent, thereby avoiding the reduction in signal intensity.

DETAILED DESCRIPTION OF THE PREFERRED EMBODIMENTS

Figure 1:
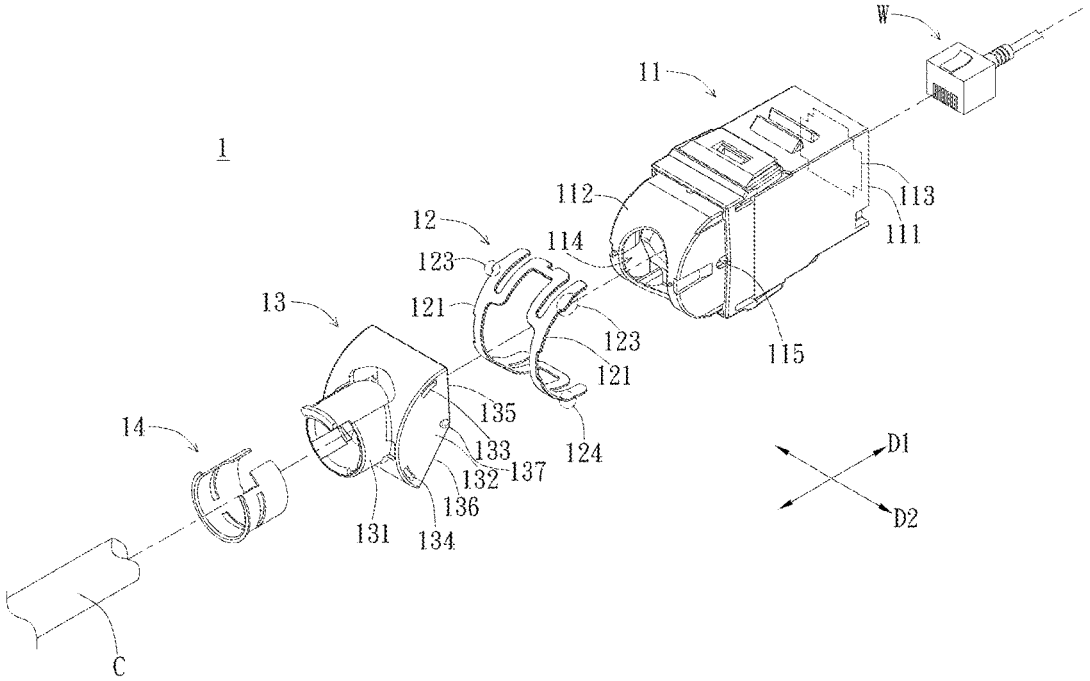
FIG. 1 is an exploded schematic view illustrating an electrical connector according to one embodiment of the present invention.

The following description illustrates the embodiments of the present invention with reference to the appended drawings. Practical details regarding the embodiment of the present invention will be described therein; however, these practical details should not be construed as limitations to the scope of the present invention. In addition, to present the drawings in a concise manner, traditional structures and components will be simplified in the drawings.

Please refer to FIG. 1. The electrical connector 1 of the present embodiment includes a body 11, a positioning component 12, a movable cover 13, and a metal ring 14. The body 11 includes a first end 111 and a second end 112 facing away therefrom. The first end 111 has a first socket 113 where the electrical plug W is connected. The electrical plug W can be, for example, an Ethernet cable, but the present invention is not limited thereto. The second end 112 has a second socket 114 where the transmission line C is connected. More specifically, the transmission line C is electrically connected to the second socket 114. The transmission line C can be exemplified as a cable, but is not limited thereto. In the present embodiment, the direction along which the transmission line C or the electrical plug W are arranged is defined as the first direction D1.

It is worthwhile noting that the circuitry inside the body 11, i.e. the way in which the electrical plug W, the transmission line C and the circuit board are connected, is well known in the art, and thus will not be further described herein.

The positioning component 12 is disposed on the second end 112 and includes a first rib 123 and a second rib 124 on each of the lateral sides 121 thereof. Specifically, the first ribs 123 are respectively disposed on the upper portion of each lateral side 121, and the second ribs 124 are respectively disposed on the lower portion of each lateral side 121. The aforementioned terms "upper" and "lower" refer to the opposite directions parallel to the direction of gravity. The first ribs 123 and the second ribs 124 protrude from the lateral sides 121 along the second direction D2 that is perpendicular to the first direction D1.

The movable cover 13 is disposed on a side of the positioning component 12 away from the body 11. The movable cover 13 has a clamping portion 131 on a side thereof facing away from the body 11. The clamping portion 131 is used for clamping the transmission line C. The two side surfaces 132 of the movable cover 13 each include a first opening 133 and a second opening 134. Specifically, the first openings are formed on the upper portion of each of each side surface 132, and the second openings 134 are disposed on the lower portion of each side surface 132. The aforementioned terms "upper" and "lower" refer to the opposite directions parallel to the direction of gravity. Specifically, the first openings 133 and the second openings 134 are through holes penetrating the side surfaces 132 along the second direction D2.

In the present embodiment, the metal ring 14 is disposed in the clamping portion 131 so as to reinforce the fixation of the transmission line C and to ground the fixation layer of the transmission line C.

The movable cover 13 includes a first side rim 135 and a second side rim 136 on the side thereof facing the positioning component 12. More specifically, the first side rim 135 and the second side rim 136 respectively extend in opposite directions from a common point. Furthermore, the extension line of the first side rim 135 and that of the second side rim 136 do not coincide with one another. The side surface 132, the first side rim 135, and the second side rim 136 on the same side of the movable cover 13 are in a fan shape.

In practice, the angle between the first side rim 135 and the second side rim 136 is preferably larger than 90 degrees and smaller than 180 degrees.

The movable cover 13 of the present invention is pivotable upwards and downwards about the positioning component 12. To be specific, two inner surfaces of the movable cover 13 respectively include a protruding shaft 137 extending towards each other. More specifically, the protruding shafts 137 extend in the second direction D2. In addition, each of the side walls of the second end 112 of the body 11 has an opening 115 corresponding to one of the protruding shaft 137. The openings 115 are formed extending along the second direction D2. When the protruding shafts 137 are fitted with the openings 115, the movable cover 13 pivots about the positioning component 12 with the protruding shafts 137 being the pivot axis.

Figure 2A:
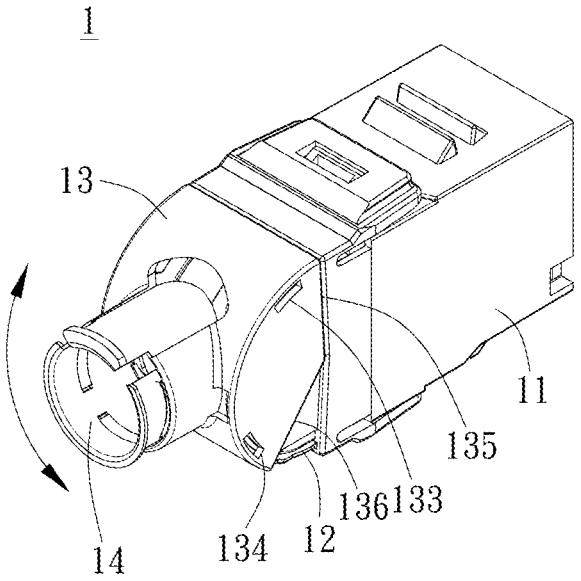
FIG. 2A and FIG. 2B are schematic views illustrating the electrical connector according to one embodiment of the present invention.
Figure 2B:
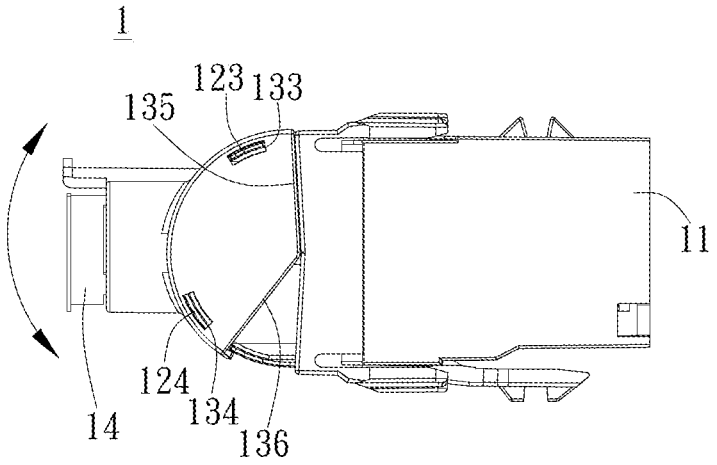

Referring to FIG. 2A and FIG. 2B for the pivot mechanism between the movable cover 13 and the positioning component 12, when the first openings 133 are fitted with the first ribs 123, i.e. when the first ribs 123 protruding from the lateral sides 121 are inserted into the first openings 133, the first side rim 135 is fitted to the body 11. The aforementioned scenario is defined as the movable cover 13 rotating to the first position.

Figure 3A:
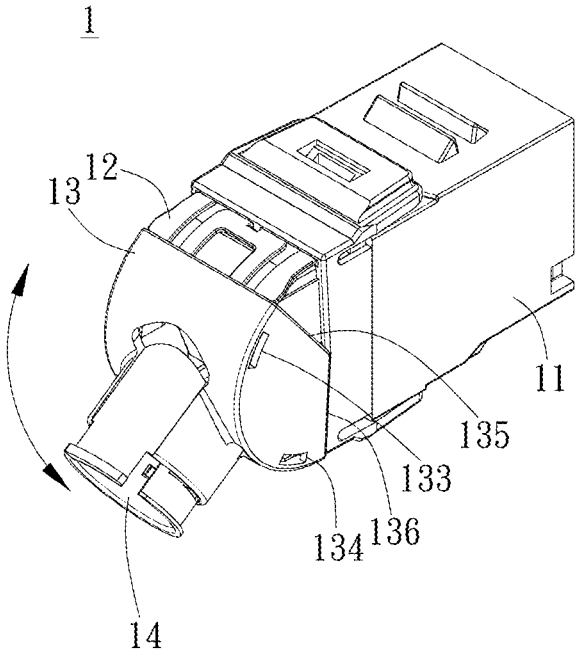
FIG. 3A and FIG. 3B are schematic views illustrating the electrical connector according to another embodiment of the present invention.
Figure 3B:
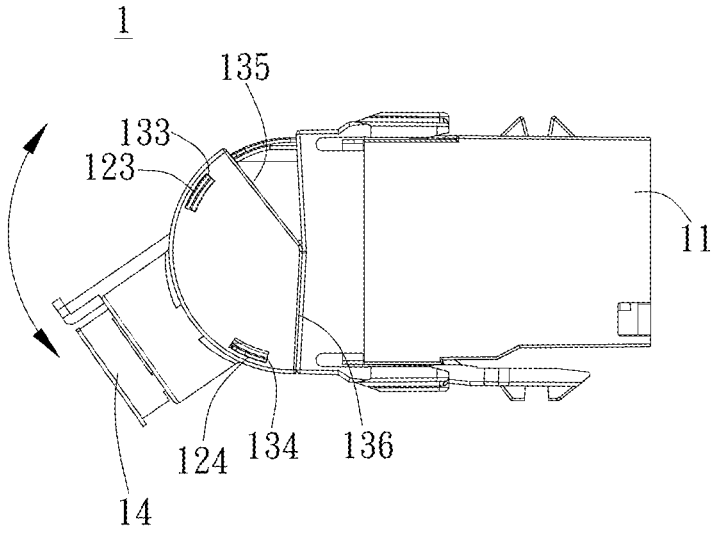

On the other hand, when the second openings 134 are fitted with the second ribs 124 as shown in FIG. 3A and FIG. 3B, i.e. when the second ribs 124 protruding from the lateral sides 121 are inserted into the second openings 134, the second side rim 136 is fitted to the body 11. The aforementioned scenario is defined as the movable cover 13 rotating to the second position.

Referring to the drawings, the extension line of the first side rim 135 and that of the second side rim 136 do not coincide with each other. Therefore, the first side rim 135 and the second side rim 136 will not be fitted to the body 11 at the same time. That is to say, when the movable cover 13 is in the first position, only the first side rim 135 is fitted to the body 11; at the same time, the second side rim 136 is not in contact with the body 11, and the second openings 134 are not fitted with the second ribs 124.

When the movable cover 13 is in the second position, the second side rim 136 is fitted to the body 11. That is to say, when the movable cover 13 is in the second position, only the second side rim 136 is fitted to the body 11; at the same time, the first side rim 135 is not in contact with the body 11, and the first openings 133 are not fitted with the first ribs 123.

It should be noted that, the inner surfaces of the second end 112 of the body 11, the positioning component 12, and the movable cover 13 are preferably curved surfaces complementary with each other such that the movable cover 13 can pivot smoothly.

With the structural solution of the present invention, the electrical connector of the present invention enables cables to be inserted thereto at an angle in accordance with the installation environment.

In other embodiments, the lateral sides 121 of the positioning component 12 can be provided with more ribs. Accordingly, the side surfaces 132 of the movable cover 13 can have more openings corresponding to the added ribs. In this way, the electrical connector of the present invention can provide more insertion angles for the cables. People skilled in the art should be able to modify the embodiments of the present invention, the details of which omitted herein, and the modifications should still fall within the scope of the present invention.

Compared to electrical connectors in the prior art, the electrical connector of the present invention enables the adaption of the angle at which the transmission line enters the electrical connector with the structure of the movable cover and that of the positioning component, preventing the transmission line from being overly bent, thereby avoiding the reduction in signal intensity.

What is claimed is:

1. An electrical connector, comprising:

a body having a first end and a second end facing away from the first end, in which the first end has a first socket to which an electrical plug is connected, and the second end has a second socket to which a transmission line is electrically connected along a first direction;

a positioning component disposed at the second end, the positioning component having a first rib and a second rib on each of the lateral sides thereof, in which the first rids and the second ribs protrude from the lateral sides along a second direction perpendicular to the first direction; and a movable cover disposed on a side of the positioning component away from the body, wherein the movable cover is rotatable relative to the positioning component.

2. The electrical connector according to claim 1, wherein two inner surfaces of the movable cover each include a protruding shaft arranged facing each other and extending along the second direction, and two side walls of the second end each include an opening corresponding to the protruding shafts, in which the protruding shafts are fitted with the openings such that the movable cover is rotatable relative to the positioning component.

3. The electrical connector according to claim 1, wherein the movable cover includes:

a clamping portion for clamping the transmission line and protruding away from the body; and two side surfaces, each having a first opening and a second opening, wherein when the movable cover rotates to a first position, the first openings are fitted to the first ribs, and when the movable cover rotates to a second position, the second openings are fitted to the second ribs.

4. The electrical connector according to claim 3, further comprising a metal ring disposed in the clamping portion.

5. The electrical connector according to claim 3, wherein the movable cover further includes a first side rim and a second side rim, in which when the movable cover is in the first position, the first side rim is fitted to the body, and when the movable cover is in the second position, the second side rim is fitted to the body, and wherein the first side rim and the second side rim are fitted to the body at different times.

6. The electrical connector according to claim 5, wherein the first side rim and the second side rim respectively extend in opposite directions from a common point, and an extension line of the first side rim does not coincide with that of the second side rim.

* * * * *